US005783357A

United States Patent [19]

Rüger

[11] Patent Number: 5,783,357

[45] Date of Patent: Jul. 21, 1998

[54] TERTIARY AMINO CONTRAST INCREASERS FOR ULTRAHIGH CONTRAST SILVER HALIDE RECORDING MATERIAL

[75] Inventor: Reinhold Rüger, Rödermark, Germany

[73] Assignee: E. I. du Pont de Nemours and Company, Wilmington, Del.

[21] Appl. No.: 616,407

[22] Filed: Mar. 15, 1996

[30] Foreign Application Priority Data

Mar. 23, 1995 [DE] Germany ..... 195 10 614.8

[51] Int. Cl.[6] ..... G03C 1/10; G03C 5/29

[52] U.S. Cl. ..... 430/264; 430/600; 430/603

[58] Field of Search ..... 430/264, 599, 430/600, 603

[56] References Cited

U.S. PATENT DOCUMENTS

| | | | |
|---|---|---|---|
| 4,975,354 | 12/1990 | Machonkin et al. | 430/264 |
| 5,229,248 | 7/1993 | Sanpei et al. | 430/264 |

FOREIGN PATENT DOCUMENTS

| | | | |
|---|---|---|---|
| 0 032 456 B1 | 2/1983 | European Pat. Off. | G03C 5/26 |
| 0 203 521 A2 | 12/1986 | European Pat. Off. | G03C 5/30 |
| 0 422 677 A1 | 4/1991 | European Pat. Off. | G03C 5/305 |
| 0 473 342 A1 | 3/1992 | European Pat. Off. | G03C 1/10 |
| 0 539 998 A1 | 5/1993 | European Pat. Off. | G03C 1/06 |
| 43 10 327 A1 | 10/1994 | Germany | G03C 5/29 |

*Primary Examiner*—Richard L. Schilling

[57] ABSTRACT

Silver halide recording material for the production of negative images with ultrahigh contrast.

Known silver halide recording materials for the production of negative images with ultrahigh contrast contain hydrazine compounds and contrast-increasing compounds (so-called boosters). A material with a new class of such boosters is being presented here, whereby they contain a sulfonyl urea, sulfonyl urethane or sulfuryl diamide group as well as a tertiary amino group in the molecule. The invention also comprises a process for the production of black-and-white negative images with ultrahigh contrast using the material according to the invention. It is especially useful for reproduction in the pre-press stage.

11 Claims, No Drawings

TERTIARY AMINO CONTRAST INCREASERS FOR ULTRAHIGH CONTRAST SILVER HALIDE RECORDING MATERIAL

BACKGROUND OF THE INVENTION

1. Field of the Invention

The invention relates to a photographic silver halide recording material for generating black-and-white negative images with ultrahigh contrast and to its use.

2. Description of the Related Art

In photomechanical reproduction, it is often necessary to convert half-tone images into screen-dot images. For this purpose, silver halide materials are used which are developed in special processes to achieve an ultrahigh contrast, that is to say, a maximum gradient of the density curve of more than 10. A known process, for example, is the lithographic process with low-sulfite hydroquinone developers containing formaldehyde. Development in the presence of hydrazine compounds has recently gained special practical significance.

In this process, certain amino compounds are often used to further increase the contrast. Thus, for instance, EP-0,032,456-B1 claims a process in which a recording material is processed in the presence of a hydrazine compound with a hydroquinone-3-pyrazolidinone developer containing a contrast-increasing amount of an amino compound.

EP-0,473,342-A1 describes a photographic silver halide material that can be developed in a developer with a pH<11 to achieve an ultrahigh contrast. The light-sensitive coating of this material contains a hydrazine compound having a certain formula as well as an amino or quaternary onium compound and is adjusted to a pH of at least 5.9.

Developers containing a contrast-increasing amount of an amino compound are not devoid of disadvantages. The necessary concentration of the amino compound is considerable and is often close to the solubility limit. As a result of the temperature increase or of slight concentration changes due to water evaporation during use, the solubility limit can easily be exceeded and the amino compound separates out. This can lead to irregular development and to contamination of the recording materials and of the developing machine. Due to their water-vapor volatility, the separated amino compounds can also get into remote sites in the developing machine, thus causing undesired impurities as well as corrosion.

When developers are used containing known amino compounds, a very unpleasant odor occurs that is due to the high necessary concentration and volatility of these compounds.

Since the amino compounds are only soluble to a limited extent, it is difficult to formulate the developer concentrates which are commonly employed as commercially available forms. According to EP-A-0,203,521, salts of certain sulfonic acids or carboxylic acids can be used as solubility promoters. The other problems addressed, however, are not influenced by such additives.

As a rule, the known developers have a pH above 11. Therefore, they are not adequately stable for actual practice and have a highly corrosive effect on the components of the developing machines.

Although negative images with ultrahigh contrast can be generated with these known processes even with short processing times, they are still associated with certain disadvantages. Thus, the amounts of contrast-increasing additives are so great that they lead to undesired changes in the film properties, for example, in the storage stability, the drying properties after processing and in the wet-scratch resistance.

German published patent application DE-A-43 10 327 describes a process to generate negative images with ultrahigh contrast, in which the silver halide recording material is developed in the presence of compounds whose molecules have at least one quaternary nitrogen atom and at least one tertiary amine function.

In addition to hydrazine compounds, U.S. Pat. No. 4,975,354 also suggests incorporating certain secondary or tertiary amino compounds containing at least three oxyethylene units in their molecule into the silver halide materials as contrast enhancers ("boosters").

EP 0,422,677 describes the use of tertiary amino compounds with at least three oxyethylene units in their molecule as development accelerators in developer solutions that also function in the presence of hydrazine compounds.

EP 0,539,998 claims silver halide materials which, in addition to hydrazine compounds, also contain thioether compounds with tertiary amino groups.

Even with these contrast-increasing additives, satisfactory images can only be obtained if they are used in relatively large amounts. This is associated with negative effects on the properties of the recording material, for example, on storage stability, on the wet-pressure sensitivity and on the drying behavior.

SUMMARY OF THE INVENTION

The invention has the objective of creating a silver halide recording material that is suitable for generating negative images having ultrahigh contrast within a brief processing time and with a stable, odor-free and non-corrosive developer and that is free of the above-mentioned disadvantages as well as a process for the production of black-and-white negative images with ultrahigh contrast.

These objectives are achieved by silver halide recording materials especially for the production of black-and-white negative images, with at least one light-sensitive layer on at least one side of a support and optionally additional layers on the same side of the support, containing at least one hydrazine compound in the light-sensitive layer or in a layer that is in reactive connection with this layer, characterized in that, in this layer or in another layer that is in reactive connection with this layer, the recording material contains at least one contrast-increasing compound having at least one tertiary amino group and at least one sulfonyl urea, sulfonyl urethane or sulfuryl diamide group in its molecule.

It was surprisingly found that these contrast-increasing compounds which contain a sulfonyl urea, sulfonyl urethane or sulfuryl diamide group as well as a tertiary amino group make it possible to produce images with ultrahigh contrast, even with relatively low developer pH and within short developing times when these compounds are incorporated together with hydrazine compounds into silver halide recording materials.

The tertiary amino group is realized by a nitrogen atom which is bonded by single bonds to two organic radicals as well as via a bivalent bonding group to the sulfonyl urea, sulfonyl urethane or sulfuryl diamide group. In the case of the sulfonyl urea and sulfonyl urethane, the bivalent bonding groups can be linked to the sulfonyl part as well as to the urea or urethane part.

These objectives are also achieved by a process where the silver halide recording material containing the contrast-increasing compounds is subjected to imagewise exposing and developing in a developer having a pH of between 10 and 11.5.

DETAILED DESCRIPTION OF THE INVENTION

In a preferred embodiment of the invention, the contrast-increasing compound falls under one of the general formulas (A), (B) or (C) shown below:

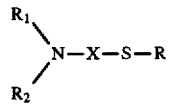

(A)

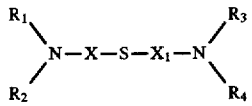

(B)

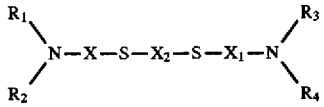

(C)

The radicals $R_1$, $R_2$, $R_3$ and $R_4$ can be the same or different and can each be a straight-chained or branched alkyl group having 1 to 6 carbon atoms, for example, methyl, ethyl, n-propyl, isopropyl, n-butyl, isobutyl and n-hexyl. $R_1$ and $R_2$ as well as $R_3$ and $R_4$, with the inclusion of the nitrogen atom and optionally of another nitrogen atom, an oxygen atom or a carbonyl group, can also form a heterocyclic ring with 5 to 12 members, for example, a piperidine, pyrrolidine, pyrrolidinone, pyrroline, oxazolidine, imidazoline, morpholine, pyrazane, azepine, oxazepine or azacyclodecane ring. Each of the groups $R_1$ to $R_4$ can also be a benzyl group. Each of the groups $R_1$ to $R_4$ as well as the heterocyclic rings corresponding to these groups can be further substituted, preferably with hydroxyl, alkoxy, alkyl thio or alkyl amino groups, whereby the alkyl can have 1 to 6 carbon atoms. Examples of such substituents are methoxy, ethoxy, propoxy, butoxy, ethyl amino, di methyl amino and butyl thio.

The bivalent bonding groups X, $X_1$ and $X_2$ are preferably straight-chained, branched or cyclic alkylene groups having 1 to 20 carbon atoms, phenylene or aralkylene groups with 7 to 20 carbon atoms, or bivalent chains made up of 1 to 20 methylene groups into which, in addition to these groups, the following can also be incorporated: oxygen, sulfur, amino groups, alkene or alkine groups or also polyoxyalkylene groups, especially polyoxyethylene or polyoxypropylene groups with 1 to 50 oxyalkyl units. Special preference is given to an ethylene or propylene amino group.

The radical R stands for a saturated or unsaturated alkyl group, preferably having 1 to 12 carbon atoms, an aryl group, preferably having 6 to 14 carbon atoms or an aralkyl group, preferably having 7 to 15 carbon atoms. These groups can, in turn, be substituted, for example, with hydroxyl, amino, alkyl amino and alkoxy groups, wherein the alkyl preferably has 1 to 6 carbon atoms. If R is bonded to nitrogen, it can also stand for hydrogen.

S stands for one of the groups $—SO_2—NR_5—CO—NR_6—$, $—SO_2—NR_7—CO—O—$ or $—NR_8—SO_2—NR_9—$. Here, $R_5$ through $R_9$, which can be the same or different, each stand for hydrogen or an alkyl group having 1 to 6 carbon atoms or a benzyl group. The alkyl and benzyl groups can be further substituted, preferably with hydroxyl, amino, alkyl amino, alkoxy and alkyl thio groups, whereby the alkyl in these groups preferably has 1 to 6 carbon atoms. The groups S can be incorporated in the order indicated or in the reverse order into the molecule according to the general formula (A), (B) or (C). Thus, for example, the radicals R and $X_2$ can be bonded to the $SO_2$ group as well as to a nitrogen or oxygen atom.

Especially preferred contrast-increasing compounds are described by the general formulas (I), (II), (III), (IV) and (V):

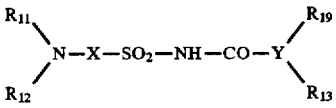

(I)

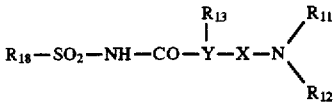

(II)

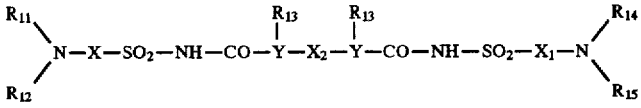

(III)

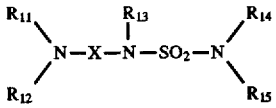

(IV)

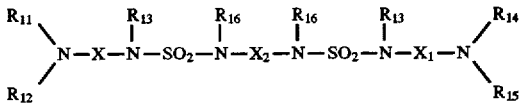

(V)

wherein $R_{11}$, $R_{12}$, $R_{14}$ and $R_{15}$, which can be the same or different, each stand for a straight-chained or branched alkyl group having 1 to 6 carbon atoms or a benzyl group, whereby these groups can be substituted with hydroxyl groups or with alkoxy, alkyl thio or alkyl amino groups, each having 1 to 6 carbon atoms, or $R_{11}$ and $R_{12}$ and/or $R_{14}$ and $R_{15}$ together with the nitrogen atom, optionally with the inclusion of another nitrogen atom or an oxygen atom or a carbonyl group, can form a five to eight-member heterocyclic ring which, in turn, can be substituted as described above, for example, a piperidine, pyrrolidine, pyrrolidinone, pyrroline, oxazolidine, imidazoline, morpholine, pyrazane, azepine or oxazepine ring.

The bivalent bonding groups X, $X_1$ and $X_2$ have the same meaning as described above.

Y stands for nitrogen or oxygen, depending on whether it is a sulfonyl urea or a sulfonyl urethane compound.

$R_{13}$ and $R_{16}$ stand for hydrogen or a straight-chained or branched alkyl group having 1 to 6 carbon atoms or a benzyl group, optionally substituted with hydroxyl groups or with alkoxy, alkyl thio or alkyl amino groups each having 1 to 6 carbon atoms. If Y is oxygen, then $R_{13}$ is not present due to the lack of another bond.

$R_{19}$ stands for hydrogen or an optionally substituted alkyl group that can also form a five to eight-member, optionally substituted, heterocyclic ring with $R_{13}$ as described above for $R_{14}$ and $R_{15}$.

$R_{18}$ is an optionally substituted phenyl, tolyl or alkyl group, preferably having 1 to 12 carbon atoms.

Since the contrast-increasing compounds according to the invention contain at least one tertiary amino group in their molecule, they can be prepared, handled and utilized in the form of a free amine and also in the form of a salt, i.e., an adduct of an acid to the free amine. A preferred acid is hydrochloric acid.

Contrast-increasing compounds according to the invention with the grouping —$SO_2$—NH—CO— can easily be made of readily available and inexpensive initial materials. In particular, chlorosulfonyl isocyanate as well as alkyl or aryl sulfonyl isocyanates are used as the basis. The synthetic method is described in general and exemplary terms in: R. Graf, Reactions with N-carbonyl sulfamic acid chloride, Angewandte Chemie [Applied Chemistry] 80, 179 (1968) as well as in G. Anthony Benson et al., Sulfamic Acid and Its N-Substituted Derivatives, Chemical Reviews 80, 151 (1980). By reacting the initial materials with the suitable alcohols or amines, simple one-pot synthesis can be used to produce the relatively complex compounds in a high yield and good purity. The person skilled in the art can easily find analogous processes by varying the substituents. In most cases, the intermediates do not have to be isolated and the compounds can be added to the photographic layers without further purification. If necessary, the synthesis product can also be purified, for example, by means of extraction with ether, by precipitation and/or by drying in a vacuum.

Contrast-increasing compounds according to the invention with sulfuryl diamide groups can be made in a simple manner by reacting sulfuryl chloride with appropriate primary or secondary amines. The reaction can be carried out either with 2 mols of amine per mol of sulfuryl chloride (for symmetrically structured compounds) or consecutively with 1 mol each of two different amines. This reaction can likewise be carried out very easily and with inexpensive initial materials.

Since these initial materials are commercially available in a wide variety, contrast-increasing compounds according to the invention can be made which meet various requirements. Thus, for example, by selecting the hydrophobic, hydrophilic and ballast groups, it is possible to ensure that the compounds have water miscibility that is adequate for incorporation into the emulsion along with a good diffusion resistance and an adsorption on silver halide that is sufficient for the desired effect. In making this selection, the compatibility with wetting agents present in the emulsion and other components can also be taken into account.

Examples of contrast-increasing compounds according to the invention are:

| | | |
|---|---|---|
| $(H_5C_2)_2N-C_3H_6-NH-SO_2-NH-CO-O-iC_3H_7$ | HCl | 1 |
| $(H_5C_2)N-C_2H_4-NH-SO_2-NH-CO-O-iC_3H_7$ | HCl | 2 |
| $(H_9C_4)_2N-C_3H_6-NH-SO_2-NH-CO-O-iC_3H_7$ | HCl | 3 |
| 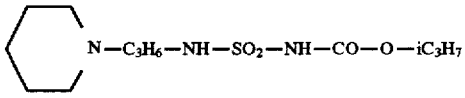 | HCl | 4 |
| 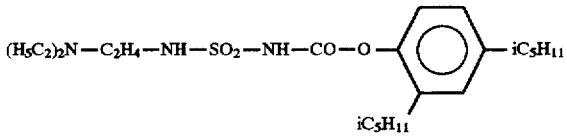 | HCl | 5 |
| 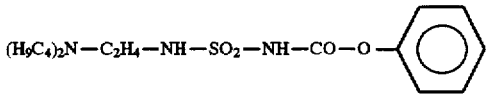 | HCl | 6 |
| $(H_9C_4)_2N-C_3H_6-NH-SO_2-NH-CO-O-tC_4H_9$ | HCl | 7 |
| $(H_9C_4)_2N-C_3H_6-NH-SO_2-NH-CO-NH-iC_3H_7$ | HCl | 8 |
| $(H_9C_4)_2N-C_3H_6-NH-SO_2-NH-CO-N(C_2H_5)_2$ | HCl | 9 |
| $((H_9C_4)_2N-C_3H_6-NH-SO_2-NH-CO-NH-C_3H_6-OC_2H_4-)_2O$ | 2 HCl | 10 |
| $((H_9C_4)_2N-C_3H_6-NH-SO_2-NH-CO-NH-CH(CH_3)CH_2-(OC_2H_4)_{\approx 22}-)_2O$ | 2 HCl | 11 |
| $((H_9C_4)_2N-C_3H_6-NH-SO_2-NH-CO-NH-CH(CH_3)CH_2-(OC_2H_4)_{\approx 5}-)_2O$ | 2 HCl | 12 |

-continued

| | | |
|---|---|---|
| 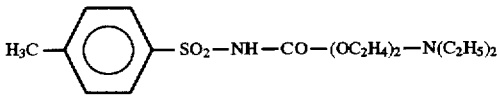 | | 13 |
| 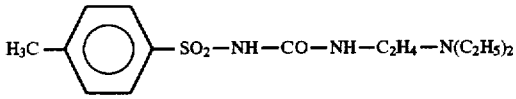 | | 14 |
| 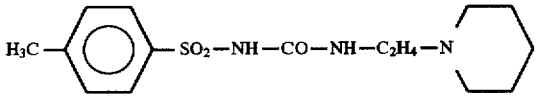 | | 15 |
| 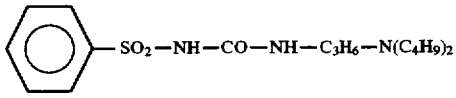 | | 16 |
| 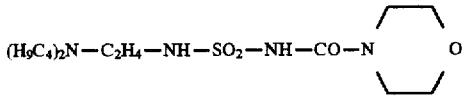 | HCl | 17 |
| $(H_9C_4)_2N-C_2H_4-NH-SO_2-NH-CO-NH-C_2H_4OH$ | HCl | 18 |
| 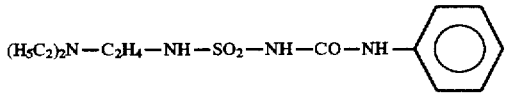 | HCl | 19 |
| 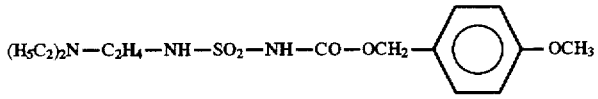 | HCl | 20 |
| 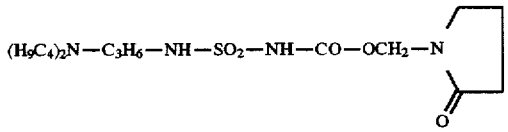 | HCl | 21 |
| $(H_9C_4)_2N-C_3H_6-NH-SO_2-NH-CO-N(C_2H_4OH)_2$ | HCl | 22 |
| 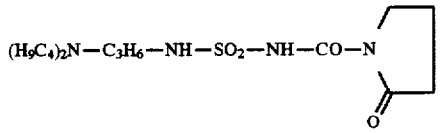 | HCl | 23 |
| $(H_5C_2)_2N-C_3H_6-NH-SO_2-NH-C_3H_6-N(C_2H_5)_2$ | 2 HCl | 24 |
| $(H_9C_4)_2N-C_3H_6-NH-SO_2-NH-C_3H_6-N(C_4H_9)_2$ | 2 HCl | 25 |
| $(H_9C_4)_2N-C_3H_6-NH-SO_2-N(CH_3)_2$ | HCl | 26 |
| 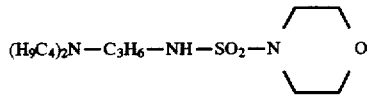 | HCl | 27 |
| 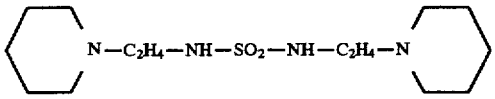 | HCl | 28 |
| $((C_4H_9)_2N-C_3H_6-NH-SO_2-NH-C_2H_4OCH_2-)_2$ | 2 HCl | 29 |
| $(C_4H_9)_2N-C_3H_6-NH-SO_2-NH-(C_2H_4O)_2H$ | HCl | 30 |
| $(H_9C_4)_2N-C_3H_6-NH-SO_2-NH-CO-NH_2$ | HCl | 31 |

The recording material according to the invention contains a hydrazine compound. This hydrazine compound can be incorporated in a generally known manner either into one or more layers of the recording material. These can be either layers containing the light-sensitive silver halide as well as layers that are in reactive connection with the former, i.e., they are arranged in such a way that substances can diffuse from one layer into the other layer, as long as a concentration gradient is maintained by reactions.

Suitable hydrazine compounds are described, for example, in Research Disclosure 235 010 November, 1983), DE-27 25 743-A1; EP-0,032,456-B1; EP-0,126,000-A2; EP-0,138,200-A2; EP-0,203,521-A2; EP-0,217,310-A2; EP-0,253,665-A2; EP-0,324,391-A2; EP-0,324,426-A2; EP-0,326,443-A2; EP-0,356,898-A2; EP-0,473,342-A1; EP-0,501,546-A1; EP-0,481,565-A1; EP-0,598,315-A1; EP-0,444,506-A1.

Preferred hydrazine compounds are described by the general formula (VI):

B—phenyl—NHNH—L—G (VI)

wherein B is a ballast group, G is an activating group and L is one of the groups —CO— or —CO—CO—.

Preferred ballast groups are those that do not attract electrons, for example, straight or branched alkyl groups (e.g., methyl, ethyl, n-propyl, isopropyl, n-butyl, isobutyl, n-hexyl, n-octyl, t-octyl, n-decyl, n-dodecyl and similar groups), also alkoxy groups containing one of the above-mentioned alkyl groups as the alkyl, as well as acyl amino groups such as acetyl amino, propanoyl amino, butanoyl amino, octanoyl amino, benzoyl amino, alkyl sulfonamido and aryl sulfonamido and similar groups.

The groups named can, in turn, be substituted with conventional photographic ballast groups of the type known from incorporated diffusion-resistant couplers and other immobilized photographic additives. Such ballast groups typically contain at least 8 carbon atoms and can be selected from relatively non-reactive aliphatic or aromatic groups such as, for example, alkyl, alkoxy, phenyl, alkyl phenyl, phenoxy, alkyl phenoxy and similar groups.

The alkyl and alkoxy groups, including any ballast groups, preferably contain 1 to 20 carbon atoms and the acyl amino groups preferably contain 2 to 21 carbon atoms. However, up to 30 or more carbon atoms can be present in these groups. Special preference is given to methoxy phenyl, tolyl, ballasted butyramido phenyl, butyl sulfonamido and toluyl sulfonamido.

The preferred hydrazine compounds include those whose ballast group also contains an adsorption-promoting group. Such groups promote the adsorption of the molecule on the surface of the silver halide crystals and they are generally known. They typically contain at least one sulfur or nitrogen atom that can form a silver complex or otherwise has an affinity to the silver halide surface. Preferred examples are thiourea, thiuronium, heterocyclic thioamide and triazole groups.

G is preferably hydrogen, optionally substituted alkyl (e.g., methyl, hydroxy methyl, monofluoromethyl, pyridinomethyl, phenoxy methyl, alkoxy methyl such as methoxy methyl), optionally substituted aralkyl (e.g., benzyl, o-hydroxybenzyl) and optionally substituted aryl (e.g., phenyl, 3,5-dichlorophenyl, o-methane sulfonamido phenyl, 4-methane sulfonyl methyl, 2-hydroxy methyl phenyl), whereby alkyl groups with electron-attracting substituents, for example, cationic groups with a quaternary nitrogen atom, are especially preferred.

G can also be further substituted, e.g. with alkyl, aralkyl, alkenyl, alkinyl, alkoxy, aryl, substituted amino, ureido, urethane, aryloxy, sulfamoyl, carbamoyl, alkyl thio or aryl thio, alkyl sulfonyl or aryl sulfonyl, alkyl sulfinyl or aryl sulfinyl, hydroxy, halogen, cyan, sulfo, aryloxy carbonyl, acyl, alkoxycarbonyl, acyloxy, carbamide, sulfonamide, carboxyl, phosphamide, diacyl amino, imide.

G can also be selected in such a way that the L—G part of the molecule is separated with ring formation as is described, for example, in EP-B-0,253,665.

Examples of suitable hydrazine compounds are:

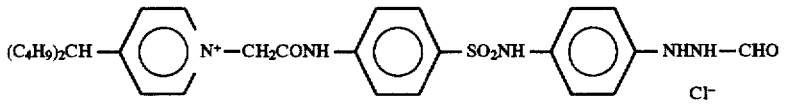

H-1

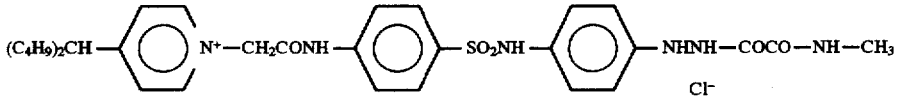

H-2

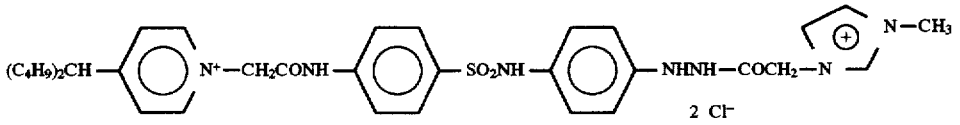

H-3

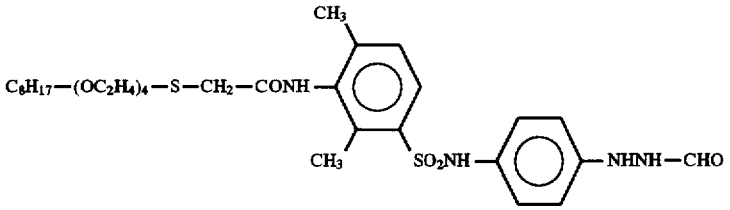

H-4

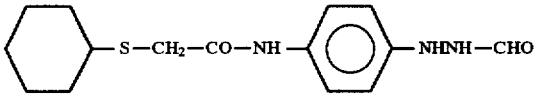

H-5

-continued

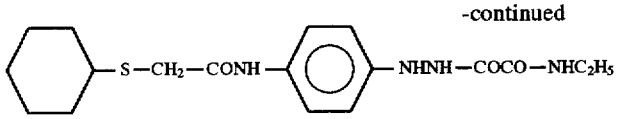

H-6

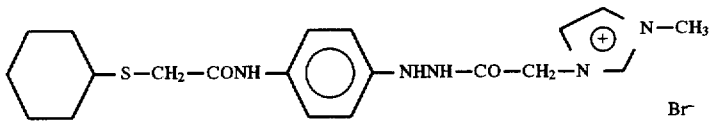

H-7

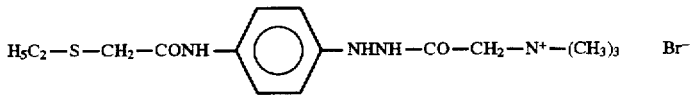

H-8

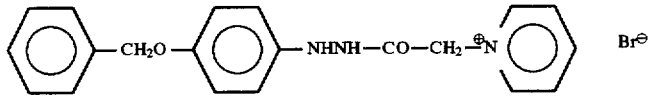

H-9

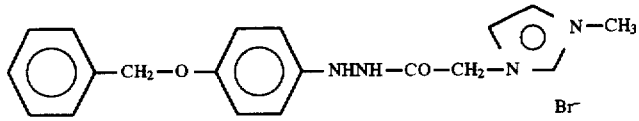

H-10

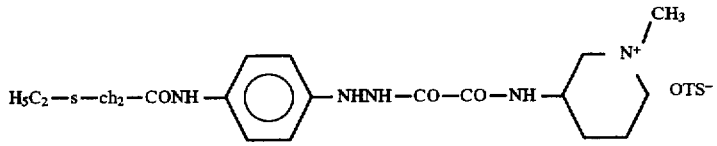

H-11

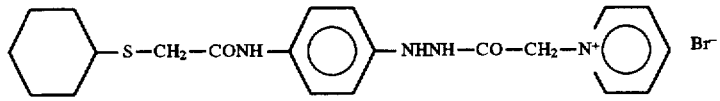

H-12

OTS— is the anion of o-toluene sulfonic acid.

The light-sensitive silver halides of the recording material used according to the invention consist of silver chloride, silver bromide, silver chlorobromide, silver bromo-iodide or silver chlorobromo-iodide. They can be monodisperse or polydisperse, can have a uniform composition or else grains with a core-shell structure, as well as mixtures of grains with different compositions and grain size distributions. They are made using a hydrophilic colloidal binder, preferably gelatin. The silver halide grains can be spherical, polyhedric or plate-like in shape. Methods for the production of suitable light-sensitive silver halide emulsions are known to the person skilled in the art and are summarized, for example, in Research Disclosure 365 044, Chapters I through IV (September, 1994).

For the recording materials used according to the invention, preference is given to silver halide emulsions that are made by means of controlled double jet precipitation and which have a cubic grain shape. Emulsions having at least 80 percent by weight of cubic silver halide grains are advantageous. Special preference is given to monodisperse emulsions, i.e., those in which the variation coefficient (quotient from standard deviation and mean value) of the grain size is smaller than 0.30.

The grain volume of the silver halide grains in the emulsions depends on the required sensitivity and can correspond, for example, to the cubic grains with edge lengths ranging from 0.1 to 0.7 μm. A preferred range is between 0.15 and 0.30 μm. During the production of the emulsion, it is possible for noble metal salts, especially salts of rhodium or iridium, to be present in the usual quantities for purposes of controlling the photographic properties.

The emulsions are preferably chemically sensitized. Suitable processes are sulfur, reduction and noble metal sensitization which can also be used in combination. For the latter, it is possible to use, for example, gold or iridium compounds. The sensitization is preferably carried out in the presence of salts of organic thio sulfonic acids such as p-toluene thio sulfonic acid.

The emulsions can be spectrally sensitized with conventional sensitization dyes as described, for example, in Research Disclosure 365 044, Chapter V (September, 1994).

The emulsions can also contain conventional antifogging agents. Preference is given to optionally substituted benzotriazole, 5-nitroindazole and 1-phenyl-5-mercaptotetrazole. These agents can be added at any point in time during the emulsion production or they can be present in an auxiliary layer of the photographic material. In order to improve the photographic properties, an iodide in an amount of about 0.5 to 5 millimol per mol of silver can be added to the emulsion before or after the chemical ripening.

The emulsions can also contain known polymer dispersions by means of which, for example, the dimensional stability of the photographic material is improved. These are, as a rule, latexes of hydrophobic polymers in an aqueous matrix. Examples of suitable polymer dispersions are given in Research Disclosure 176 043, Chapter IX B (December, 1978). Polymers of esters of acrylic and methacrylic acids are preferred, especially of alkyl esters having 1 to 6 carbon atoms. The particle size of these polymer latexes is preferably between 20 and 100 nm.

The light-sensitive layers of the photographic materials can be cured with a known agent. Such known agents are, for example, described in Research Disclosure 365 044, Chapter II B (September, 1994). This curing agent can be added to the emulsion or incorporated via an auxiliary layer, for example, an outer protective layer. Suitable curing agents are, for example, aldehydes such as formaldehyde or glutaraldehyde, vinyl sulfones, s-triazines, aziridines, carbodiimides, carbamoyl pyridinium compounds, monofunctional and bifunctional carbamoyl imidazolium compounds. A preferred curing agent is hydroxy dichlorotriazine.

The photographic material can contain further additives that are known and common for obtaining certain properties. Such agents are listed, for example, in Research Disclosure 365 044 (September, 1994) in Chapters VI (brighteners), IX A (coating auxiliaries), IX B (plasticizers and lubricants) and IX D (matting agents).

The gelatin content of the emulsions is generally between 30 and 150 grams per mol of silver; preference is given to the range between 40 and 100 grams per mol of silver.

The invention also includes a process for the production of black-and-white negative photographic images which is characterized in that a light-sensitive recording material as described above is exposed imagewise, developed in an aqueous developer solution, fixed in the usual manner, rinsed and dried.

The developer solutions used according to the invention preferably contain a dihydroxybenzene developer substance, for example, hydroquinone, pyrocatechol, methyl hydroquinone or chlorohydroquinone, and an antioxidant, preferably an alkali sulfite in a concentration of more than 0.3 mol per liter. Special preference is given to solutions with pH values of 10 to a maximum of 11. Such developer solutions can be stored well during use and they yield largely fog-free images. Types of developer solutions that can likewise be used are those with a developer substance of the ascorbic acid type, for example, L-ascorbic acid, D-ascorbic acid, L-erythroascorbic acid, 6-desoxy-L-ascorbic acid, imino-L-erythroascorbic acid or sugar derivatives of these acids. Other suitable developer solutions are those containing developer substances of the dihydroxybenzene type as well as of the ascorbic acid type.

Preferably, the developer solutions contain known auxiliary developer substances with a superadditive effect such as, for instance, N-methyl-p-aminophenol or 1-phenyl pyrazolidinone-3 or derivatives of these compounds.

Preference is likewise given to developers containing stabilizers from the groups of the benzotriazoles and mercaptotetrazoles. Such stabilizers are, for example, 1-phenyl-5-mercaptotetrazole, 1-(4-hydroxy-phenyl)-5-mercaptotetrazole, 1-(1-naphthyl)-5-mercaptotetrazole, 1-cyclohexyl-5-mercaptotetrazole, 1-(4-chlorophenyl)-5-mercaptotetrazole, 1-(3-capramidophenyl)-5-mercaptotetrazole, benzotriazole, 5-chloro-benzotriazole, 5-bromobenzotriazole, 5-methyl benzotriazole, 5-nitrobenzotriazole, 5-benzoyl aminobenzotriazole, 1-hydroxymethyl benzotriazole, 6-cyanobenzotriazole.

In the process according to the invention, the use of alkanol amines according to the state of the art is either completely superfluous or else their amount can be reduced to a small fraction. As a result, the process functions without any annoying or harmful odor nuisance and corrosion due to amino compounds volatilizing out of the developer.

The contrast-increasing compounds according to the invention can be added to the emulsion at any stage of the production process. On the basis of their molecular structure, they can be surface-active and they can also interact with ionic polymers. Thus, they can also be used as coating auxiliaries and as emulsifiers, for example, for photographically active additives, and as flocculants for hydrophilic ionic colloids such as gelatin, for instance, in a flocculation-washing process for photographic emulsions.

The invention can be used to make black-and-white negative images with ultrahigh contrast, especially during reproduction in the pre-press stage for black-and-white and multicolor prints. It is explained in greater detail by the following examples.

EXAMPLES

Example 1 (Synthesis Example)

Production of N-(3-dibutyl aminopropyl sulfamoyl)-isopropyl urethane hydrochloride (Compound 3).

An amount of 4 ml of isopropanol is dripped into a solution of 7.13 grams (0.05 mol) of chlorosulfonyl isocyanate in 30 ml of diethyl ether while being stirred at −5° C. (23° F.). The mixture is stirred for another hour and brought up to room temperature. Then 19.5 ml of dibutyl aminopropylamine (0.05 mol), dissolved in 20 ml of diethyl ether, is dripped in. The mixture is stirred at room temperature for another 8 hours, during which two phases are formed. The light-yellow oily product is separated from the ether phase, extracted twice by shaking with ether and dried in a vacuum. The yield is 19 grams of a highly viscous oil.

Example 2 (Synthesis Example)

Production of bis(diethyl aminopropyl) sulfuryl diamide dihydrochloride (Compound 24).

An amount of 6.75 grams (0.05 mol) of sulfuryl chloride is dissolved in 20 ml of diethyl ether and mixed dropwise at −20° C. (−4° F.) with a mixture of 13 grams (0.1 mol) of diethyl amino propylamine and 30 ml of diethyl ether, and subsequently with 10 ml of isopropanol. After the mixture is warmed up to room temperature, it is stirred for another 6 hours. The oily product is precipitated by means of the addition of another 100 ml of diethyl ether, washed two more times with diethyl ether and dried in a vacuum. The yield is 16.5 grams (83%) of a light-yellow, glassy solid.

Example 3 (Application Example)

A silver chlorobromide emulsion (20 mol-% bromide) with cubic grains having an edge length of 0.21 μm was produced by pAg-regulated two-beam inlet. After removing the soluble salts by means of the flocculation process, gelatin is added up to a total gelatin content of 55 grams per mol of silver and a chemical ripening is carried out in the presence of thio sulfate, gold salt and thio tosylate. Subsequently, potassium iodide (1.6 millimol per mol of silver), phenyl mercaptotetrazole, 5-nitroindazole, an aqueous polyethylene dispersion, a sensitizer for the green spectral range, wetting agents, 1-pyridinium acetyl-2-(4-benzyloxy phenyl) hydrazine (0.12 millimol per mol of silver) and sodium salt of dichlorohydroxytriazine (0.10 millimol per gram of gelatin) were added to the emulsion. The emulsion was made together with a protective layer solution, the gelatin, matting agents, nonyl phenyl diethoxy sulfate (Triton® X-200, manufacturer: Rohm & Haas) and the additives shown in Table 1 of the contrast-increasing compounds according to the invention and the comparative compounds.

The comparative compounds used were:

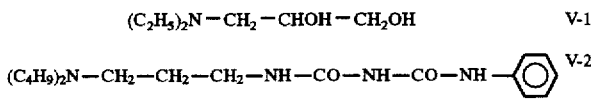

$(C_2H_5)_2N-CH_2-CHOH-CH_2OH$ V-1

$(C_4H_9)_2N-CH_2-CH_2-CH_2-NH-CO-NH-CO-NH-$ V-2

-continued

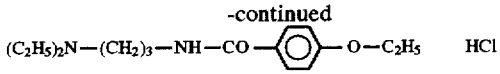

V-3

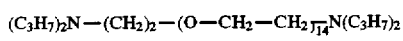

V-4

Sample strips of the recording materials obtained were exposed with white light through an original from a continuous-tone wedge and a contact screen placed under a part of it. The strips were developed in a developing machine (Dürr Graphica) at a temperature of 36° C. (96.8° F.), fixed, rinsed and dried. The development time was 28 seconds. A commercially available fixing bath was used. The developer had the following composition:

| | |
|---|---|
| Water | 500 grams |
| Sodium bisulfite | 50 grams |
| KOH | 27 grams |
| EDTA trisodium salt | 3.7 grams |
| Hydroquinone | 25 grams |
| Potassium bromide | 4 grams |
| Benzotriazole | 0.3 grams |
| Phenyl mercaptoterazole | 0.05 grams |
| 4-hydroxy methyl-4-methyl-1-phenyl pyrazolidinone | 1 gram |
| Boric acid | 3 grams |
| Sodium hydroxide | 24 grams |
| Diethylene glycol | 40 grams |

Filled up to 1 liter with water, pH at 10.5 at 22° C. (71.6° F.).

The processed strips were evaluated according to the following criteria: minimum density (Dmin); maximum density (Dmax); sensitivity (S) as the density of the continuous-tone wedge in the original at the place that yields the half-tone value of 50% in the half-tone image; foot gradation (G1) between the density values D=0.1 and 0.4 in the continuous-tone image; main gradation (G2) between D=1.0 and 2.5; as well as a visual evaluation of the dot quality (PQ) of the screen dots. A score of 10 means optimal sharpness of the dots, 4 to 5 is only somewhat useable and corresponds to the sharpness of a Rapid Access Film without contrast intensification, and 1 to 3 is unusable. The results are compiled in Table 1.

TABLE 1

| Test | Additive Compound mg/m² | | Dmin | Dmax | S | G1 | G2 | PQ |
|---|---|---|---|---|---|---|---|---|
| 1 | — | | 0.04 | 5.2 | 1.20 | 4.0 | 9.0 | 5 |
| 2 | V1 | 40 | 0.04 | 5.2 | 1.24 | 4.2 | 8.9 | 5 |
| 3 | V2 | 40 | 0.04 | 5.2 | 1.24 | 5.5 | 12 | 5 |
| 4 | V3 | 40 | 0.04 | 5.2 | 1.22 | 4.4 | 9 | 5 |
| 5 | V4 | 40 | 0.04 | 5.2 | 1.44 | 9.5 | >25 | 9 |
| 6 | 4 | 20 | 0.04 | 5.2 | 1.35 | 9.4 | >25 | 9 |
| 7 | 4 | 40 | 0.04 | 5.2 | 1.40 | 9.2 | >25 | 9 |
| 8 | 9 | 40 | 0.04 | 5.2 | 1.35 | 9.6 | >25 | 9 |
| 9 | 11 | 20 | 0.04 | 5.2 | 1.33 | 8.8 | >25 | 9 |
| 10 | 14 | 20 | 0.04 | 5.2 | 1.35 | 9 | >25 | 9 |
| 11 | 10 | 20 | 0.04 | 5.3 | 1.50 | 8 | 25 | 9 |
| 12 | 23 | 20 | 0.04 | 5.3 | 1.50 | 8 | 25 | 9 |
| 13 | 21 | 20 | 0.04 | 5.3 | 1.47 | 9.6 | >25 | 9 |
| 14 | 21 | 10 | 0.04 | 5.3 | 1.44 | 7.3 | 17 | 8 |
| 15 | 22 | 20 | 0.04 | 5.3 | 1.50 | 7.5 | 23 | 9 |
| 16 | 24 | 20 | 0.04 | 5.2 | 1.34 | 6.9 | 16 | 7 |
| 17 | 26 | 20 | 0.04 | 5.2 | 1.41 | 7.6 | 20 | 8 |
| 18 | 27 | 20 | 0.04 | 5.4 | 1.51 | 11 | >25 | 9 |

The results show that film samples containing the compounds according to the invention already yield an ultrahigh gradation at a pH value of 10.5, even if they are developed in a developer without contrast-increasing amino compound. Comparison compounds V1 to V3, on the other hand, only yield a slight increase in the sensitivity and in the gradation.

What is claimed is:

1. A light-sensitive silver halide recording material for the production of black-and-white negative images, with at least one light-sensitive layer having a silver halide emulsion on at least one side of a support, the light-sensitive layer containing at least one hydrazine compound and characterized in that the light-sensitive layer contains at least one contrast-increasing compound having at least one tertiary amino group and at least one sulfonyl urea or sulfonyl urethane group in its molecule.

2. A light-sensitive silver halide recording material for the production of black-and-white negative images, with at least one light-sensitive layer having a silver halide emulsion on at least one side of a support, and at least one other layer on the same side of the support as the light-sensitive layer and in reactive relationship with the light-sensitive layer containing at least one hydrazine compound characterized in that the at least one other layer contains at least one contrast-increasing compound having at least one tertiary amino group and at least one sulfonyl urea or sulfonyl urethane group in its molecule.

3. The light-sensitive silver halide recording material of claim 1 or 2 characterized in that the contrast-increasing compound falls under one of general formulas (A), (B) or (C):

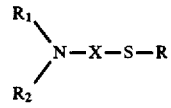

(A)

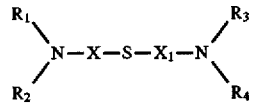

(B)

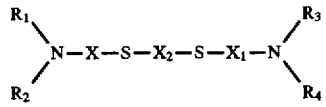

(C)

wherein $R_1$ to $R_4$ are the same or different and can be an optionally substituted alkyl group having 1 to 6 carbon atoms or an optionally substituted benzyl group or $R_1$ and $R_2$ and/or $R_3$ and $R_4$ together with the nitrogen atom and optionally another oxygen or nitrogen atom or a carbonyl group and stand for a five to twelve-member ring, X, $X_1$ and $X_2$ stand for a bivalent bonding group, R stands for a saturated or unsaturated alkyl group, an aralkyl group or an aryl group, these groups can be further substituted, and if it is bonded to a nitrogen atom, it can also be hydrogen, S stands for one of the groups $SO_2$—$NR_5$—CO—$NR_6$—, or —$SO_2$—$NR_7$—CO—O— wherein $R_5$ to $R_7$ can be the same or different and stand for hydrogen or an optionally substituted $C_1$ to $C_6$ alkyl group or benzyl group and whereby these groups S can be incorporated in the order indicated or in the reverse order into the molecule having the general formula (A), (B) or (C).

4. The light-sensitive silver halide recording material according to claim 3, characterized in that the compound having formula (A), (B) or (C) belongs to one of the groups described by the following general formulas (I), (II), (III), (IV) or (V):

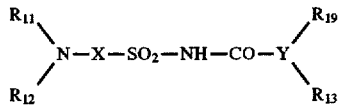

(I)

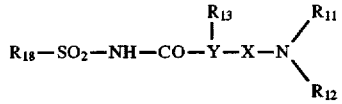

(II)

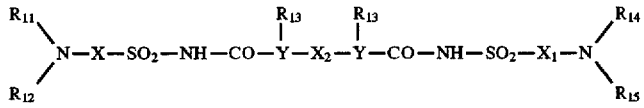

(III)

wherein $R_{11}$, $R_{12}$, $R_{14}$, $R_{15}$ can be the same or different, each stand for a straight-chained or branched alkyl group having 1 to 6 carbon atoms or a benzyl group, whereby these groups can be substituted with hydroxyl groups or with alkoxy, alkyl thio or alkyl amino groups, each having 1 to 6 carbon atoms, or $R_{11}$ and $R_{12}$ and/or $R_{14}$ and $R_{15}$ together with the nitrogen atom, optionally with the inclusion of another nitrogen or an oxygen atom or a carbonyl group, stand for a five to eight-member heterocyclic ring which, in turn, can be substituted, X, $X_1$, $X_2$ are each a bivalent bonding group, Y stands for nitrogen or oxygen, $R_{13}$, stands for hydrogen or a straight-chained or branched alkyl group having 1 to 6 carbon atoms or a benzyl group, optionally substituted with hydroxyl groups or with alkoxy, alkyl thio or alkyl amino groups each having 1 to 6 carbon atoms, $R_{13}$ is not present when Y is oxygen, $R_{19}$ is hydrogen or an optionally substituted alkyl group which can also form a five to eight-member, optionally substituted heterocyclic ring with $R_{13}$, $R_{18}$ is an optionally substituted phenyl, tolyl or alkyl group.

5. The light-sensitive silver halide recording material according to claim 1 or 2, characterized in that the hydrazine compound has the general formula (VI):

B—phenyl—NHNH—L—G (VI)

wherein B is a ballast group, G is an activating group and L is one of the groups —CO— or —CO—CO—.

6. The light-sensitive silver halide recording material according to claim 1 or 2, characterized in that it contains the contrast-increasing compound in an amount ranging from 0.05 to 5 grams per mol of silver.

7. The light-sensitive silver halide recording material according to claim 1 or 2, characterized in that the silver halide in the emulsion comprises more than 80% by weight of cubic grains.

8. The light-sensitive silver halide recording material according to claim 1 or 2, characterized in that the silver halide in the emulsion has an average grain size of 0.15 to 0.30 μm.

9. The light-sensitive silver halide recording material according to claim 1 or 2, characterized in that the silver halide in the emulsion is monodisperse.

10. A process for the production of a black-and-white negative image with ultrahigh contrast, characterized in that a recording material according to claim 1 or 2 is subject to imagewise exposing and developing in a developer with a pH between 10 and 11.5.

11. The process of claim 10, characterized in that the developer contains more than 0.30 mols of sulfite per liter.

* * * * *